US008397410B1

(12) United States Patent
Lau

(10) Patent No.: US 8,397,410 B1
(45) Date of Patent: Mar. 19, 2013

(54) INTEGRATED TABBED NOTE WITH BINDER CLIP

(76) Inventor: Janet K. Lau, Union City, CA (US)

( * ) Notice: Subject to any disclaimer, the term of this patent is extended or adjusted under 35 U.S.C. 154(b) by 17 days.

(21) Appl. No.: 13/231,747

(22) Filed: Sep. 13, 2011

Related U.S. Application Data

(60) Provisional application No. 61/382,381, filed on Sep. 13, 2010.

(51) Int. Cl.
*G09F 3/16* (2006.01)

(52) U.S. Cl. ..... 40/666; 116/236; 116/237; D19/65; 40/659

(58) Field of Classification Search ..... 40/359, 40/300, 641, 659; 116/236, 237; 206/447, 206/449; 24/67.5, 557, 558, DIG. 8, DIG. 9
See application file for complete search history.

(56) References Cited

U.S. PATENT DOCUMENTS

| | | | | | |
|---|---|---|---|---|---|
| 332,327 | A | | 12/1885 | Clark | |
| 863,265 | A | | 8/1907 | Crouse | |
| 876,252 | A | * | 1/1908 | Baker | 40/641 |
| 962,397 | A | | 6/1910 | Whitmore | |
| 1,052,505 | A | | 2/1913 | Munger et al. | |
| 1,123,008 | A | * | 12/1914 | Rice | 116/237 |
| 1,158,940 | A | | 11/1915 | Litt et al. | |
| 1,178,113 | A | | 4/1916 | Turton et al. | |
| D50,594 | S | | 4/1917 | Voges | |
| 1,345,365 | A | | 7/1920 | Hutchison | |
| 1,465,576 | A | | 8/1923 | Biggs | |
| 1,501,067 | A | | 7/1924 | Schaffert | |
| 1,524,478 | A | | 1/1925 | Hunter | |
| 1,587,335 | A | | 6/1926 | Kline | |
| 1,661,165 | A | | 3/1928 | Cameron | |
| 1,778,031 | A | | 10/1930 | Kinch | |
| 1,802,980 | A | | 4/1931 | Marsh | |
| 1,826,580 | A | | 10/1931 | Spinney | |
| 1,840,604 | A | * | 1/1932 | Randall | 24/67.11 |
| 1,843,687 | A | | 2/1932 | Lovell | |
| 1,894,906 | A | * | 1/1933 | Henry, Jr. | 40/641 |
| 1,914,671 | A | | 6/1933 | O'Neil | |
| 1,976,465 | A | | 10/1934 | Thomson | |
| 1,977,096 | A | | 10/1934 | Straubel | |
| 1,985,866 | A | | 12/1934 | Lan kenau | |
| 1,997,894 | A | * | 4/1935 | Woodley | 24/67.11 |
| 2,008,019 | A | | 7/1935 | Horlick, Jr. | |
| D104,956 | S | | 6/1937 | Baker | |
| 2,118,043 | A | | 5/1938 | Goza | |
| 2,156,743 | A | | 5/1939 | Skrebba | |
| 2,232,939 | A | | 2/1941 | Cohen | |
| 2,248,317 | A | | 7/1941 | Van Cleef | |
| 2,323,552 | A | | 7/1943 | Marion | |
| D136,639 | S | | 11/1943 | Hoffman | |
| 2,362,445 | A | | 11/1944 | Blodgett | |
| 2,415,248 | A | * | 2/1947 | Kenna et al. | 40/641 |
| 2,420,021 | A | | 5/1947 | Straubel | |

(Continued)

FOREIGN PATENT DOCUMENTS

| | | |
|---|---|---|
| DE | 3904006 A1 | 10/1989 |
| FR | 2474960 A2 | 8/1981 |

(Continued)

*Primary Examiner* — Joanne Silbermann
*Assistant Examiner* — Shin Kim
(74) *Attorney, Agent, or Firm* — Aka Chan LLP

(57) ABSTRACT

A tabbed note includes a note sheet having an opening and at least two slits and a binder clip. Both slits extend to touch the opening. One slit extends to touch an edge of the note. A binder clip is inserted into one of the slits and positioned to block the opening from a front view of the tabbed note.

20 Claims, 13 Drawing Sheets

U.S. PATENT DOCUMENTS

| | | | | | |
|---|---|---|---|---|---|
| 2,582,785 | A | | 1/1952 | Luppold | |
| 2,623,311 | A | | 12/1952 | Condon | |
| 2,695,026 | A | | 11/1954 | Broneer | |
| 2,774,124 | A | | 12/1956 | Brady | |
| 3,073,046 | A | | 1/1963 | Condon | |
| 3,090,347 | A | * | 5/1963 | Harnett, Jr. | 116/237 |
| 3,107,673 | A | * | 10/1963 | Haddad | 402/79 |
| 3,123,924 | A | | 3/1964 | Roberts | |
| 3,225,469 | A | | 12/1965 | Chase | |
| 3,247,602 | A | | 4/1966 | Hamilton et al. | |
| 3,290,810 | A | | 12/1966 | Morena | |
| 3,313,408 | A | | 4/1967 | Gilbert | |
| 3,347,361 | A | | 10/1967 | Lindeke | |
| 3,360,877 | A | | 1/1968 | Estep | |
| 3,361,252 | A | | 1/1968 | Wise | |
| 3,381,654 | A | * | 5/1968 | Hupp et al. | 116/237 |
| 3,910,412 | A | | 10/1975 | Vargo | |
| 3,934,368 | A | | 1/1976 | Fearing | |
| D241,342 | S | | 9/1976 | Carroll | |
| 4,024,832 | A | * | 5/1977 | Machnikowski | 116/237 |
| D268,848 | S | | 5/1983 | Lorber | |
| 4,384,417 | A | | 5/1983 | Thompson | |
| 4,425,724 | A | | 1/1984 | Scott | |
| 4,646,455 | A | | 3/1987 | Gardner | |
| 4,655,427 | A | | 4/1987 | Lamb | |
| 4,691,458 | A | | 9/1987 | Scott | |
| D295,540 | S | | 5/1988 | Rabig | |
| D299,571 | S | | 1/1989 | Kiyooka et al. | |
| 4,951,408 | A | | 8/1990 | Banks | |
| D314,012 | S | | 1/1991 | Klodt | |
| D327,183 | S | | 6/1992 | Meyer | |
| 5,161,712 | A | | 11/1992 | Olson | |
| 5,170,535 | A | | 12/1992 | Strong | |
| 5,199,203 | A | | 4/1993 | Jones | |
| 5,445,272 | A | | 8/1995 | Crisp | |
| 5,481,784 | A | | 1/1996 | Sinaiko | |
| 5,507,459 | A | | 4/1996 | Kiera | |
| D382,405 | S | | 8/1997 | Ohayon | |
| D383,789 | S | | 9/1997 | Shyu | |
| 5,695,219 | A | | 12/1997 | Crawford | |
| D409,245 | S | | 5/1999 | Wolff | |
| 5,947,302 | A | | 9/1999 | Miller | |
| D416,040 | S | | 11/1999 | Kasom et al. | |
| 5,996,130 | A | | 12/1999 | Verhines | |
| D465,525 | S | | 11/2002 | Dilday | |
| D476,172 | S | | 6/2003 | Bourne, Sr. | |
| D632,335 | S | * | 2/2011 | Pascale | D19/65 |
| 2002/0072723 | A1 | | 6/2002 | Ronn et al. | |
| 2002/0134299 | A1 | * | 9/2002 | Chua | 116/237 |
| 2002/0166497 | A1 | * | 11/2002 | Rae | 116/237 |
| 2004/0099717 | A1 | | 5/2004 | Lee | |
| 2005/0217078 | A1 | | 10/2005 | Groch et al. | |
| 2006/0000133 | A1 | | 1/2006 | Windorski | |
| 2007/0209254 | A1 | | 9/2007 | Perlo | |

FOREIGN PATENT DOCUMENTS

| | | | |
|---|---|---|---|
| JP | 09-071065 | A | 3/1997 |
| JP | 2001-353992 | A | 12/2001 |

* cited by examiner

INTEGRATED TABBED NOTE WITH BINDER CLIP

CROSS-REFERENCE TO RELATED APPLICATIONS

This application claims the benefit of U.S. provisional patent application 61/382,381, filed Sep. 13, 2010, which is incorporated by reference along with all other references cited in this application.

BACKGROUND OF THE INVENTION

The present invention relates generally to providing tabs which may be readily clipped on and unclipped from one or more sheets of paper. More particularly, the present invention relates to a tab section and a fastener (e.g., binder clip) that enables the grouping of one or more sheets of paper.

Despite great strides and advances in electronic technology, the birth of the Internet, and continued promises of the paperless office, paper remains critical to the functioning of society and business today. Using paper is familiar, easy, reliable, and relatively inexpensive. With paper comes the need to organize and manage the growing mountains of paper better. Some of the most successful inventions in human history are tools or devices to manage paper better: Some well-known examples that quickly come to mind include the paper clip, binder clip, staple, stapler, file folder, binder, and many others.

Given a mountain of papers, some of the papers may be more important than other papers in the mountain, or groups of papers may have a different priority than other groups in the mountain. It would be very time consuming if one were to start from the beginning each time he or she were searching for a particular piece of paper. Therefore, to organize one or more sheets of paper such that specific sheets of paper may be readily identified, tabbed folders may be used. An individual may label folders to essentially provide labels for any sheets of paper contained therein. By way of example, when papers are to be separated into high priority and low priority groups, the tab portion of one folder may be labeled "high priority" and used to hold high priority papers, while the tab portion of another folder may be labeled "low priority" and used to hold low priority papers. Additional descriptions or notations pertaining to the contents of the folders may be printed or written directly onto the folders.

While the use of tabbed folders in the organization of papers is effective, the use of tabbed folders is not always desirable. Tabbed folders may be bulky, and if multiple folders are needed to organize papers, the amount of bulk added by the tabbed folders may be cumbersome. In addition, the need to open tabbed folders to view the contents of the folders may prove to be inconvenient.

Tabs or labels may be provided directly on sheets of paper to allow for the efficient filing of the sheets of paper. For example, a label may be positioned and glued over a paper clip. When the paper clip is secured to one or more sheets of paper, the label may be used to effectively label the sheets of paper when a printed card is received within the label. While such a label may be effective in allowing sheets of paper to be organized, having to remove a printed card held within the label when the text on the printed card is no longer relevant may be inefficient. Further, the label and paper clip assembly does not allow for additional notes regarding the sheets of paper held by the assembly to be made thereon.

Post-It® notes, which are available from 3M Incorporated of St. Paul, Minn., may be used to provide tabs for a sheet or sheets of paper, and are reusable. Post-it notes may be erased, as well as readily removed and reused. Despite the success of Post-it notes, there are shortcomings such as the inability to secure multiple papers together and not necessarily reliable and substantial in all circumstances. For example, Post-it notes are sometimes too easily removable, even by accident. Over time, Post-it notes may simply loose their adhesiveness.

Though a Post-it note may be positioned on a sheet of paper such that a portion of the Post-it note extends above an edge of the sheet of paper to effectively form a tab while a portion of the Post-it note that does not extend above the edge may serve to allow notes to be made thereon, the tab is relatively flimsy. Hence, the tab portion of a Post-it note used to form a tab may be accidentally bent such that any writing on the tab portion is obscured. In addition, a Post-it note may relatively easily become detached from a sheet of paper to which it is affixed, and is not arranged to secure multiple sheets of paper together.

Therefore, what is needed is a method and an apparatus which is relatively easy to reuse, and allows one or more sheets of paper to be securely tabbed. That is, what is desired is a tab arrangement which is reusable, secures one or more sheets of paper, and allows notes in addition to notations on a tab to be written thereon.

BRIEF SUMMARY OF THE INVENTION

A tabbed note includes a note sheet having an opening and at least two slits and a binder clip. Both slits extend to touch the opening. One slit extends to touch an edge of the note. A binder clip is inserted into one of the slits and positioned to block the opening from a front view of the tabbed note. The note sheet may be made from paper, card stock, fiberboard, plastic, polymer, a wood-based material, a petroleum-based material, a recycled material, a composite material, or other material.

In an implementation, a card or a small piece of paper material that includes a tab portion may be attached to the sheet of paper using fastener (e.g., binder clip) to effectively enable the sheet of paper to be tabbed. When the card is fastened to the sheet of paper, the tab portion extends above or beyond an edge of the sheet of paper. Such a tab portion may be written on to enable the sheet of paper to be labeled, while the remainder of the card may be used for writing notes.

In an implementation, a method for forming a tabbed note assembly includes obtaining a body with an opening and slits or slots defined therein, obtaining a fastener, and positioning the fastener with respect to the body. The slits or slots extend to touch the opening. At least one of slits or slots extends to touch an edge of the tabbed note. The fastener (e.g., binder clip) is positioned such that a first portion of the fastener is on one side of the body while a second portion of the fastener is on another side of the body. In an embodiment, the fastener is a paper a binder clip.

In an implementation, a kit includes: (1) a package, the package having two or more compartments. The compartments including a first compartment and a second compartment. (2) A first set of tabbed note assemblies. The first set of tabbed note assemblies includes a first tabbed note assembly have a first tabbed note and a first binder clip. The first tabbed note has a first tab portion and a first note portion. The first note portion and the first tab portion are defined by a different colored printing in these portions. The first tabbed note has a first opening which is blocked from a front view by the first binder clip. The first set of tabbed notes is positioned at least partially in the first compartment. (3) A second set of tabbed note assemblies. The second set of tabbed note assemblies includes a second tabbed note assembly having a second tabbed note and a second binder clip. The second tabbed note has a second tab portion and a second note portion. The second note portion and the second tab portion are defined by a different colored printing in these portions. The second tabbed note has a second opening which is blocked from a front view by the second binder clip. The second set of tabbed notes is positioned at least partially in the second compartment.

A tabbed note assembly includes at least one piece of a paper product that has a first side, a second side, a tab portion, and a note portion. The paper product has one larger opening with slits or slots that extend to touch a boundary of the larger opening. The assembly also includes a fastener (e.g., binder clip) that is at least partially disposed in at least one slit or slot.

When the fastener (e.g., binder clip) is disposed in the one opening, the fastener contacts both the first side and the second side of the paper product. In one embodiment, the paper product has a polygonal shape. In another embodiment, the paper product has a bottom edge and the fastener has a first top edge and a first bottom edge.

Further, a tabbed note of the invention may be clipped to a single piece of paper in a secure, but removable manner. Before or while the tabbed note it attached, a user may write on the tabbed portion. The fastener portion of the tabbed may be reusable. For example, the note or paper portion (which has an opening or hole in a specific embodiment) of the tabbed note may be removed and a replacement paper portion (with a similar opening or hole) may be used with the same fastener.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1A:
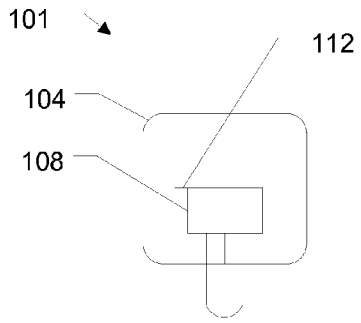
FIG. 1A shows a tabbed note assembly 101.

FIG. 1A shows a tabbed note assembly 101 in accordance with an embodiment of the present invention. The tabbed note assembly includes a tabbed note 104 and a fastener 108. See also U.S. patent application Ser. No. 11/534,625, filed Sep. 22, 2006, which is incorporated by reference.

The tabbed note includes an opening 112 through which the fastener may be inserted (more details on the opening below). The fastener is arranged to enable the tabbed note assembly to be fastened to or otherwise attached to a sheet of paper or paper-based product or a document. The tabbed note assembly may also be fastened to other items such as, for example, cardboard, wood, book or binder cover, folder, plastic, polymer, card stock, leather, fabric, or another type of material that can be written on or attached to, and combinations of these.

Figure 1B:
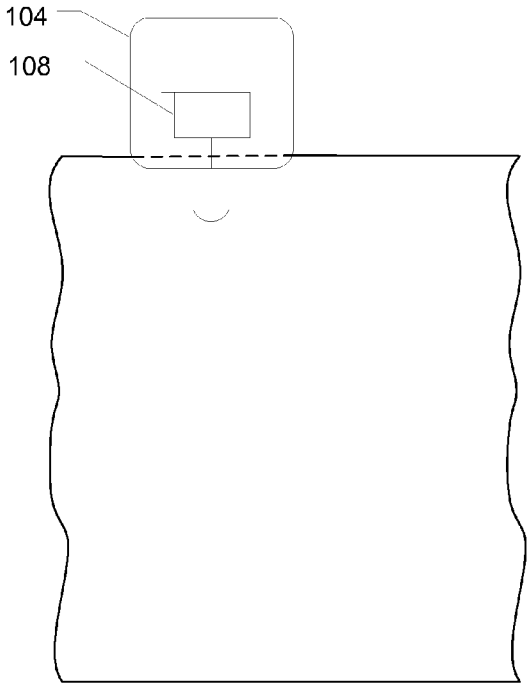
FIGS. 1B-1C show the tabbed note assembly fastened to a sheet of paper.
Figure 1C:
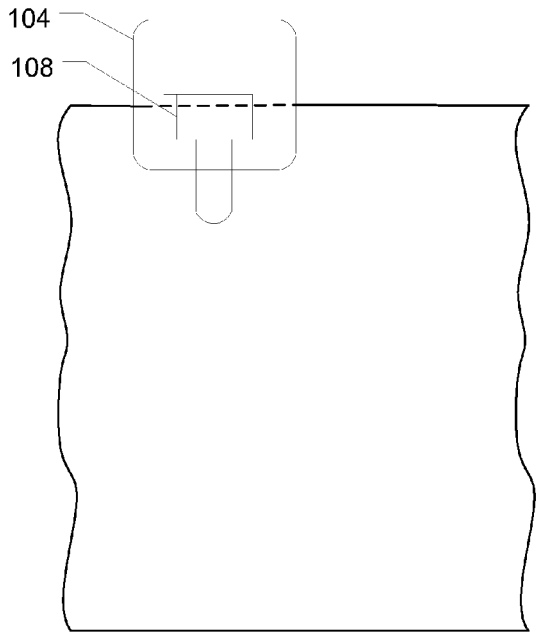

FIGS. 1B-1C the tabbed note assembly fastened to a sheet of paper in accordance with an embodiment of the present invention. The tabbed note may be attached to the sheet of paper using the fastener.

Figure 2:
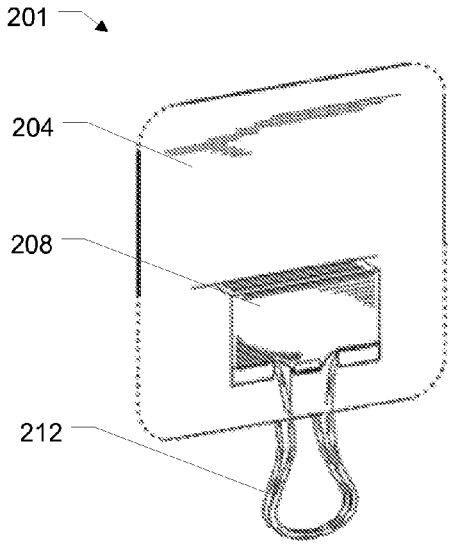
FIG. 2 shows a perspective view of a tabbed note assembly.

In an embodiment, the invention is an integrated tabbed note and binder clip. FIG. 2 shows a perspective view of a specific implementation of a tabbed note assembly 201 in accordance with an embodiment of the present invention. The tabbed note assembly includes a tabbed note 204 and a binder clip 208. The binder clip has at least two handles or clasps 212 positioned in a first or downward position. When the handles or clasps are in the downward position, the tabbed note assembly can be more easily attached to a sheet of paper.

Figure 3:
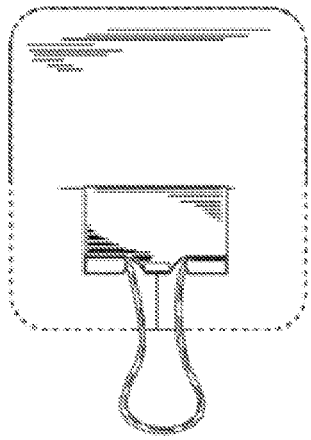
FIG. 3 shows a front view of the tabbed note assembly.
Figure 4:
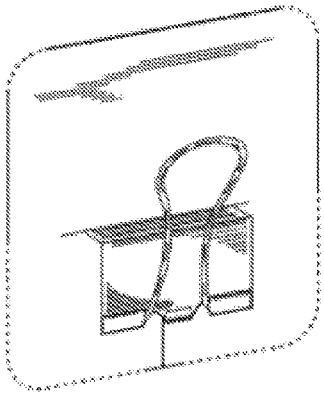
FIG. 4 shows another perspective view of the tabbed note assembly with handles or clasps positioned in an upward position.
Figure 5:
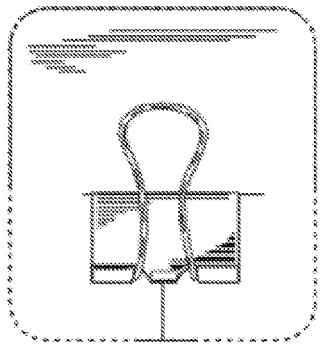
FIG. 5 shows a front view of the tabbed note assembly with handles or clasps positioned in an upward position.
Figure 6:
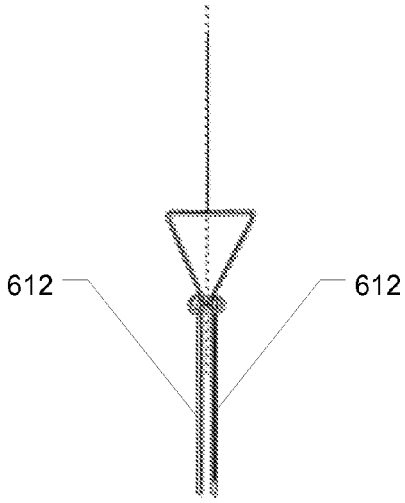
FIG. 6 shows a side view of the tabbed note assembly with handles or clasps positioned in a downward position.
Figure 7:
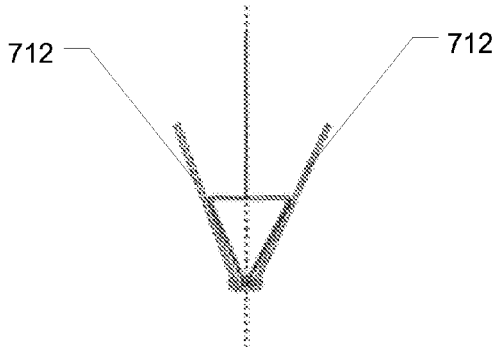
FIG. 7 shows a side view of the tabbed note assembly with clasps positioned in an upward position.
Figure 8:
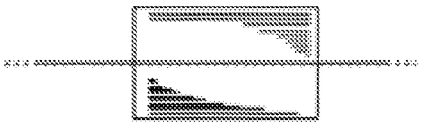
FIG. 8 shows a view of the tabbed note assembly from a top edge of the note.
Figure 9:
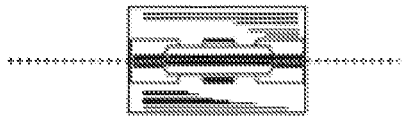
FIG. 9 shows a view of the tabbed note assembly from a bottom edge of the note.

FIG. 3 shows a front view of the tabbed note assembly. FIG. 4 shows another perspective view of the tabbed note assembly. The clasps are positioned in a second or upward position. In an implementation, the second position is substantially opposite from the first position. FIG. 5 shows a front view of the tabbed note assembly with the clasps positioned in an upward position. FIG. 6 shows a side view of the tabbed note assembly with clasps 612 positioned in a downward position. FIG. 7 shows a side view of the tabbed note assembly with clasps 712 positioned in an upward position. FIG. 8 shows a top edge view of the tabbed note assembly. FIG. 9 shows a bottom edge view of the tabbed note assembly.

Figure 10:
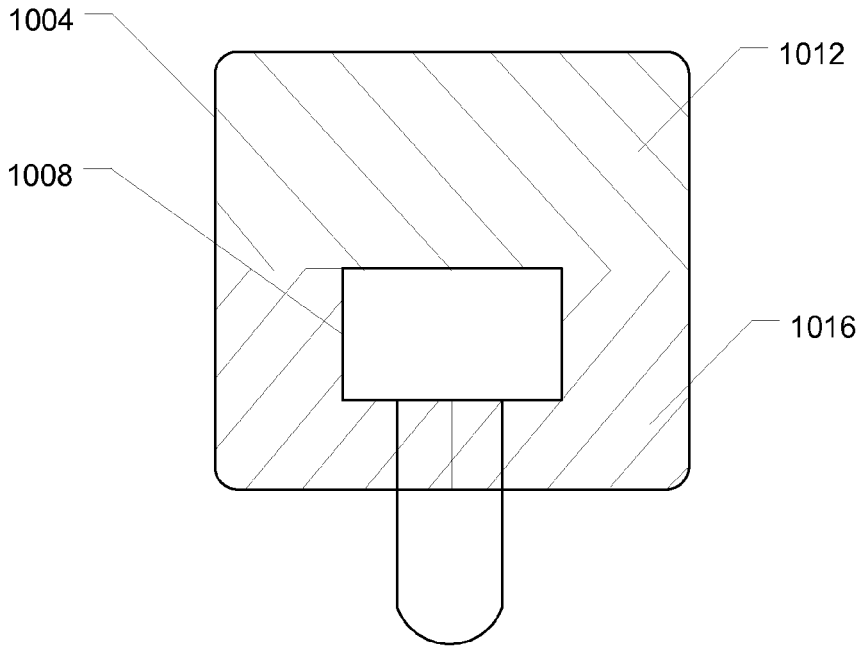
FIG. 10 shows a tabbed note assembly having a tabbed note and fastener.

FIG. 10 shows a tabbed note assembly having a tabbed note 1004 and fastener 1008. The tabbed note has a first portion 1012 and a second portion 1016. The first portion extends or protrudes above a top of a sheet of paper when the tabbed note is fastened to the sheet of paper. A user may write information on the first portion for example to enable the sheet of paper to be readily identified. This information remains visible even when the sheet is in a stack with other sheets.

The second portion extends below the profile of the sheet of paper when the tabbed note is fastened to the sheet of paper. A user may make notations on the second portion. For example, a user may write notes regarding the sheet of paper on the second portion of the tabbed note.

The fastener allows the tabbed note to be relatively securely fastened to the sheet of paper, and the insertion of the fastener through an opening reduces the likelihood that the fastener and the tabbed note may become separated. In general, the opening may be positioned such that when the fastener is inserted through the opening and the tabbed note is fastened to one or more sheets of paper, the tab extends above the profile of one or more sheets of paper.

In another implementation of the invention, the second portion note may be behind the sheet of paper, and the fastener will be on top of the sheet. The fastener is arranged such that when the tabbed note assembly is fastened to the sheet, the fastener is effectively fastened about both the sheet and the tabbed note.

A tabbed note can have one or more colors. For example, a tabbed note can be red, orange, yellow, green, blue, purple, or any combination of these. In an implementation, the first portion is a first color and the second portion is a second color. The first portion and second portion may have different shades of a color.

Figure 11:
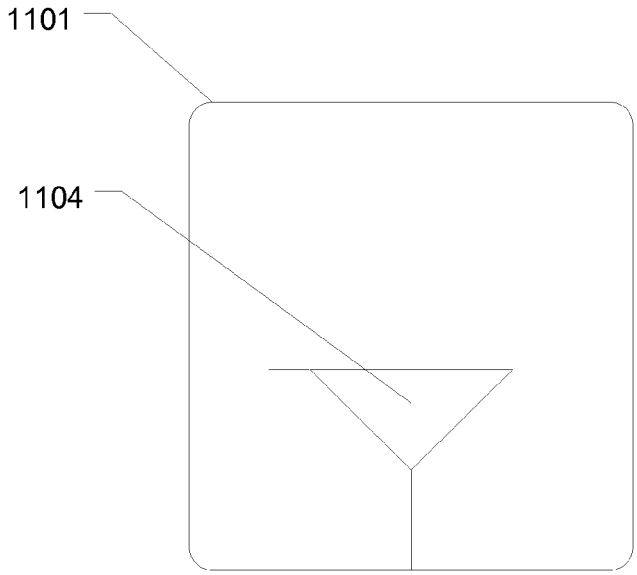
FIG. 11 shows a specific implementation of a tabbed note.

FIG. 11 shows a specific implementation of a tabbed note 1101. The tabbed note has an opening 1104. The opening should be large enough to allow the fastener to be inserted through it. This opening may be a hole or cutout. In the figure, the opening is a triangular shaped opening. This is not intended to limit the invention. An opening may have various shapes, sizes, or configurations. For example, in other implementations, the opening can other shapes including polygon, trapezoid, square, rectangle, circle, ellipse, rounded triangle, rounded rectangle, rounded square, or others. The opening is configured and sized to enable a desired fastener to be readily inserted therethrough. The length of the opening should be long enough to allow the fastener to be inserted through it. As discussed above, the location of the opening for the fastener may vary depending on the specific implementation of the invention.

Some specific flows and techniques are described for making an integrated tabbed note with binder clip of the invention in this application, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data.

A tabbed note assembly which includes a tabbed note and fastener is clipped to a sheet of paper. In an implementation, the process includes:

1. Providing a fastener.

Figure 12:
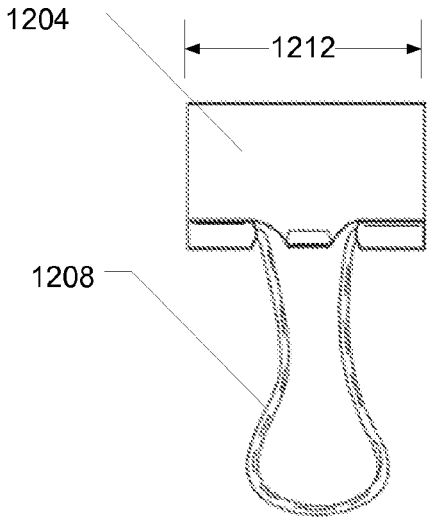
FIG. 12 shows a binder clip fastener having a binding portion and handles or clasps.
Figure 13:
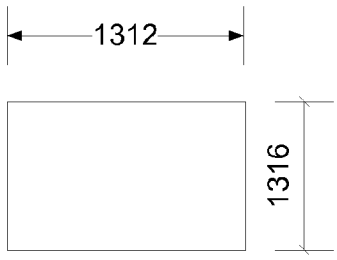
FIG. 13 shows a top view of the binder clip fastener.
Figure 14:
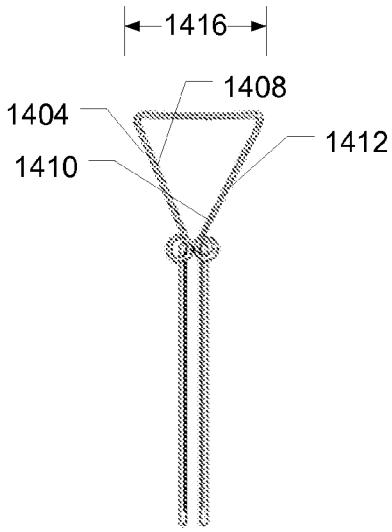
FIG. 14 shows a side view of the binder clip fastener.

FIGS. 12-14 show various views of a binder clip. A binder clip such as shown and described in U.S. Pat. No. 1,139,627, issued May 18, 1915, may be used. The handles of the binder clip can be flipped to an up position or down position. In the up position, the handles can be used to unclip or release the binder clip. In the down position, the handles can rest against papers to which the binder clip is binds. In an implementation, the handles can also be removed by squeezing them together and unlatching them from the clip. Other binder clip designs may also be used.

FIG. 12 shows a fastener having a binding portion 1204 and handles or clasps 1208. The binding portion has a length 1212 at a top of the binding portion. FIG. 13 shows a top view of the fastener. The top of the binding portion has a length 1312 and a width 1316. FIG. 14 shows a side view of the fastener. The fastener has a first side edge 1404, a second side edge 1408, a third side edge 1410, and a fourth side edge 1412. The first and second sides are opposite each other. The third and fourth sides are opposite each other. The second and third sides face each other.

2. Providing a tabbed note.

Figure 15:
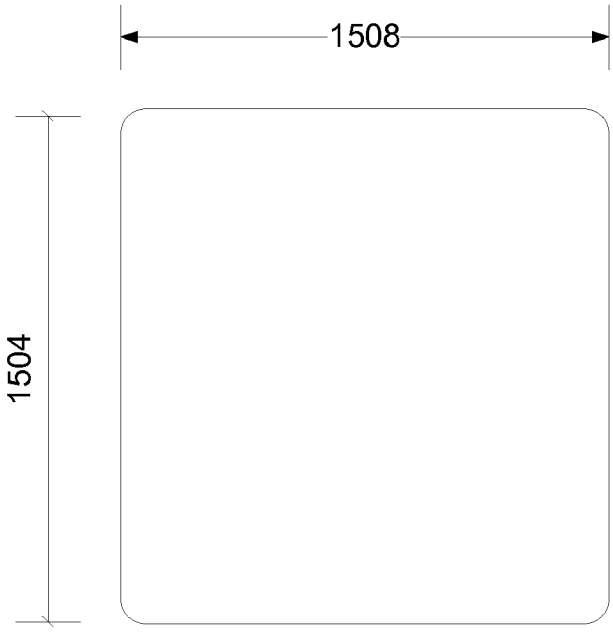
FIG. 15 shows a specific implementation of a tabbed note.

FIG. 15 shows a specific implementation of a tabbed note. Between a bottom side and a top side of the tabbed note is a first distance 1504. Between a left side and a right side of the tabbed note is a second distance 1508.

The first and second distances may vary depending on how big a user desires the tabbed note to be. In an implementation, the first distance is 4.5 centimeters and the second distance is 4 centimeters. The first distance can be less than or greater than 4.5 centimeters and the second distance can be less than or greater than 4 centimeters. For example, in another implementation, the first distance is approximately 3.8 centimeters and the second distance is approximately 4 centimeters. In another implementation, the first distance is approximately 3.9 centimeters and the second distance is approximately 3 centimeters.

3. Making a first slit from a side of the tabbed note along a first direction. Various means can be used to make a slit in the tabbed note. For example, in an implementation, a user uses scissors to create the first slit. In another implementation, a knife is used to create the first slit. In another implementation, a machine creates the incision to create the first slit. In another implementation, a user tears the tabbed note to create the first slit.

Figure 16:
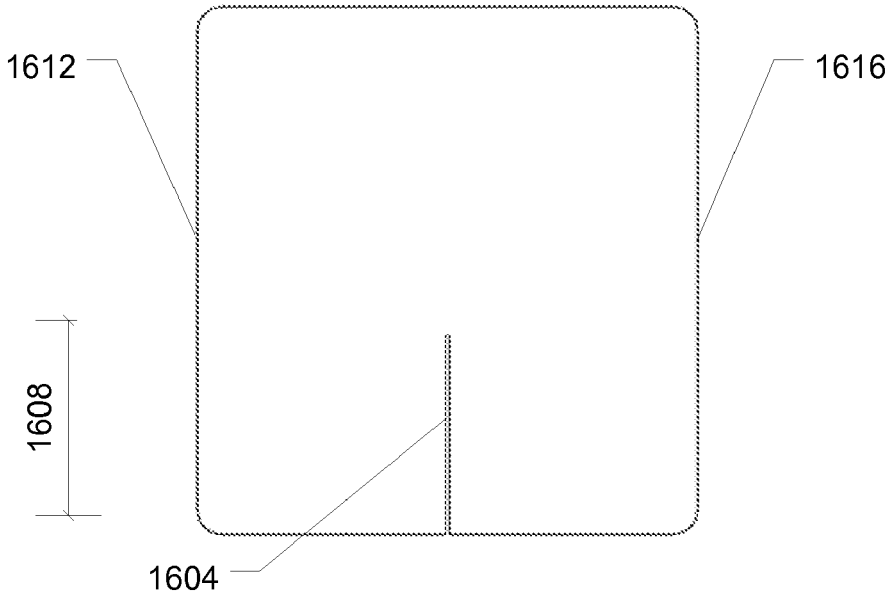
FIG. 16 shows a tabbed note having a first slit or slot.

FIG. 16 shows a tabbed note having a first slit 1604. The first slit has a length 1608 from a side of the tabbed note. In an implementation, the first slit is equidistant from a first side 1612 and a second side 1616 of the tabbed note. In another implementation, the first slit is not equidistant from the first and second sides of the tabbed note. In this implementation, the first slit can be located closer to the first side or closer to the second side.

The first slit extends to touch a bottom edge of the tabbed note, and is perpendicular or approximately perpendicular to this bottom edge. In other implementations, the first slit to be angled respect to bottom edge (e.g., 80 degrees, 75, degrees, 60 degrees, 45 degrees, or other angles).

4. Making a second slit in a second direction in the tabbed note. Between a left side and a right side of the second slit is a distance 1720. In an implementation, the second slit is made as small as possible. In an implementation, distance 1720 is slightly greater than a distance 1212 of the binder clip (see FIG. 12).

In an implementation, the second slit is centered vertically between opposite edges of the note. In another implementation, the second slit is positioned (visually) off center vertically between opposite edges of the note.

Further, in an implementation, the second slit is centered horizontally between opposite bottom and top edges of the note. In another implementation, the second slit is positioned visually off center horizontally between opposite edges of the note. For example, the top portion of the note may be larger than the bottom portion. Of the bottom portion may be larger than the top portion.

The various vertical and horizontal positioning of the slit can be combined in any possible combination. For example, the second slit can be both off center vertically and horizontally, where the top portion is larger. The second slit can be centered vertically and off center horizontally, where the top portion is larger.

The width of a slit or slot (e.g., first or second slits) can have any desirable width. The slit may narrow, such as a cut in the note. Or the slit may be wider (e.g., 1 millimeter or 2 millimeters) so that a larger opening is formed.

Figure 17:
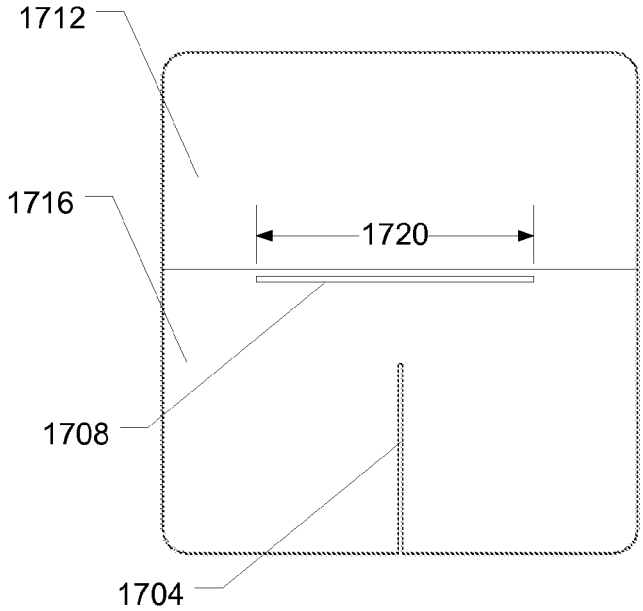
FIG. 17 shows a tabbed note having a first slit and a second slit or slot.

FIG. 17 shows a tabbed note having a first slit 1704 and a second slit 1708. The tabbed note also has a first portion 1712 and a second portion 1716. In the figure, the second slit is cut just under the first portion. A distance between a bottom side of the tabbed note and the second slit is greater than a distance between the second slit and where the first and second portions meet. In this implementation, the second slit is not located in the first portion of the tabbed note.

In an implementation, the first and second directions are substantially transverse. For example, the first slit can be in a direction substantially parallel to a top side of the tabbed note and the second slit can be in a direction substantially parallel to a left side of the tabbed note.

5. Making an opening between the first slit and the second slit. In an implementation, the opening is a size such that the opening is not noticeable in the tabbed note assembly. The smaller the opening, the harder is may be or the longer it may take to put the binder clip through the opening because more precision is required.

Figure 18:
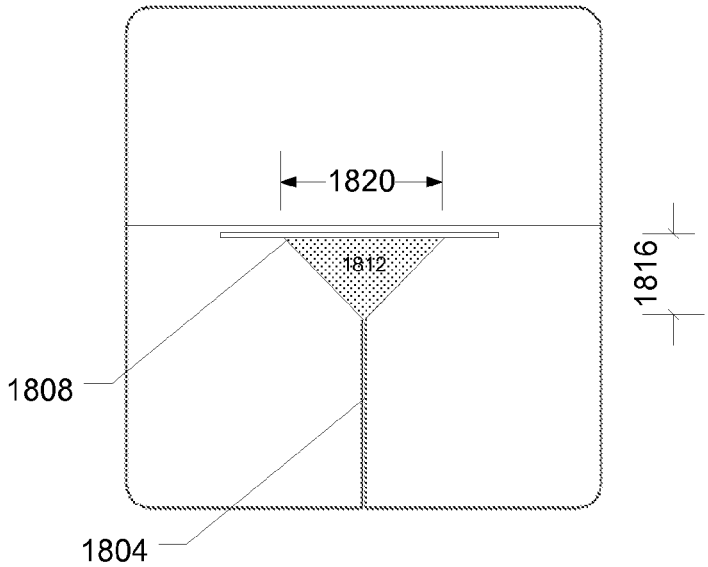
FIG. 18 shows a tabbed note having a first slit, a second slit, and an opening.

FIG. 18 shows a tabbed note having a first slit 1804, a second slit 1808, and an opening 1812. Between the first and second slits is a distance 1816. A side of the opening closer to the second slit is a length 1820. Note that the slits extend and touch opening 1812. Slit 1804 extends to touch both opening 1812 and the bottom edge of the note.

To manufacture the tabbed note, the slits or slots and the opening may be formed in the tabbed note using a single die cut or punch. Or the slits or slots and opening may be formed in multiple die cut or punch operations.

In an implementation, second slit 1808 is off center vertically (between two opposite side edges of the note), while opening 1812 is centered vertically. This results in the slit extending a greater distance from a boundary of the opening on one side (of the slit) than the other side. In another implementation, second slit 1808 is centered vertically and opening 1812 is also centered vertically.

Figure 19:
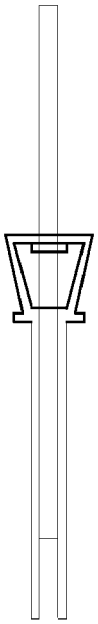
FIG. 19 shows a side view of a tabbed note assembly.

6. Positioning the binder clip partially within the opening. Sides of the binder clip contact a front and a back of the tabbed note when the binder clip is in a closed, or clamped, position, as shown in FIG. 19. To enable the tabbed note assembly to be used to tab a sheet of paper, forces or moments are generally applied to the binder clip.

The binder clip into the note through slit 1804. Opening 1812 facilitates turning of the clip so that it can be positioned into slit 1808. When the binder clip is positioned into place on the note, in an implementation, opening 1812 is not visible, being blocked by the binder clip.

Figure 20:
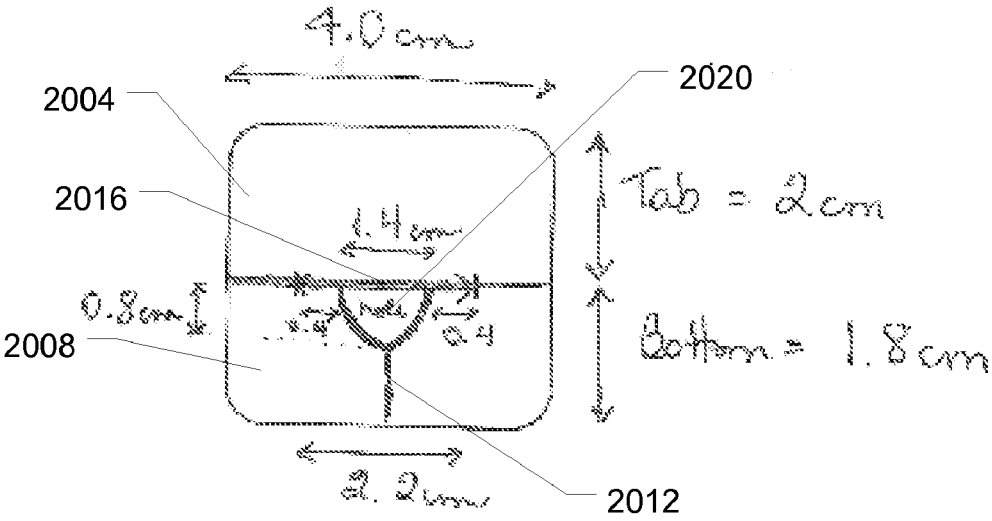
FIG. 20 shows a specific implementation of a tabbed note.

Embodiments of the invention may have varying tabbed note dimensions, slit lengths, described distances, and configurations. FIG. 20 shows a specific implementation of a tabbed note in accordance with an embodiment of the present invention. The tabbed note has a first portion or tab portion 2004 and a second portion or bottom portion 2008. A distance between a left side of the tabbed note and a right side of the tabbed note is approximately 4.0 centimeters. A distance between a bottom side of the tabbed note and where the bottom and tab portions meet is approximately 1.8 centimeters. A distance between a top side of the tabbed note and where the bottom and tab portions meet is approximately 2.0 centimeters.

From a bottom side of the tabbed note, a length of a first slit 2012 is approximately 1.0 centimeters. A second slit 2016 is in the bottom portion of the tabbed note. The second slit has a length of approximately 2.2 centimeters.

An opening or hole 2020 is between the first and second slits. The sides of the hole have a curved shape. A distance between a top of the first slit and the second slit is approximately 0.8 centimeters. A distance between an upper left corner of the hole closer to the second slit and an upper right corner of the hole closer to the second slit is approximately 1.4 centimeters.

The hole can be located at a center between left and right sides of the tabbed note. In an implementation, a distance between a left side of the second slit and a closer side of the hole is approximately 0.4 centimeters, and a distance between a right side of the second slit and a closer side of the hole is approximately 0.4 centimeters.

Figure 21:
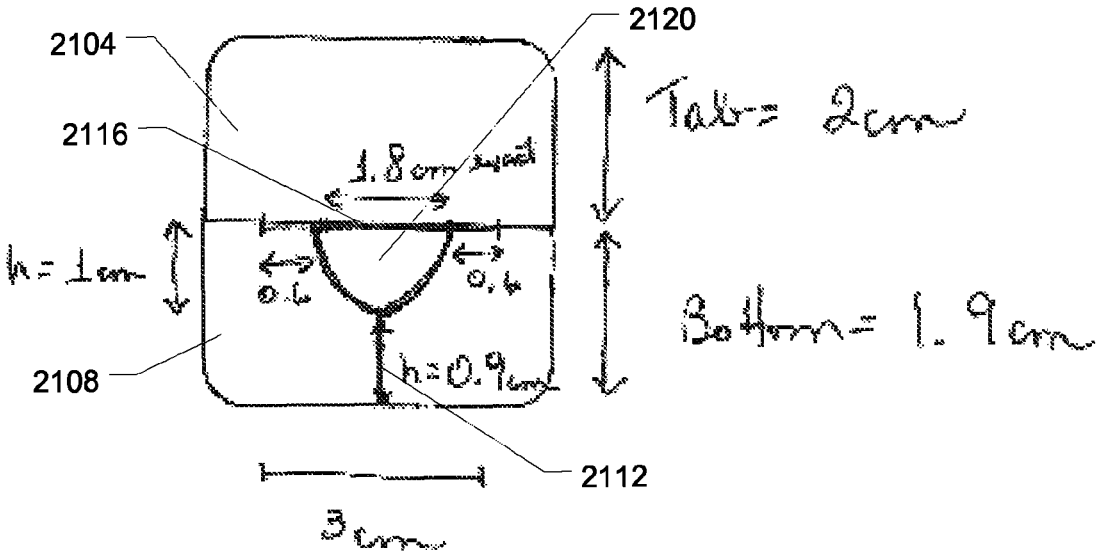
FIG. 21 shows a specific implementation of a tabbed note.

FIG. 21 shows a specific implementation of a tabbed note in accordance with an embodiment of the present invention. The tabbed note has a first portion or tab portion 2104 and a second portion or bottom portion 2108. A distance between a left side of the tabbed note and a right side of the tabbed note is at least 3.0 centimeters. A distance between a bottom side of the tabbed note and where the bottom and tab portions meet is approximately 1.9 centimeters. A distance between a top side of the tabbed note and where the bottom and tab portions meet is approximately 2.0 centimeters.

From a bottom side of the tabbed note, a length of a first slit 2112 is approximately 0.9 centimeters. A second slit 2116 is in the bottom portion of the tabbed note. The second slit has a length of approximately 3.0 centimeters.

An opening or hole 2120 is between the first and second slits. A distance between a top of the first slit and the second slit is approximately 1.0 centimeters. A distance between an upper left corner of the hole closer to the second slit and an upper right corner of the hole closer to the second slit is approximately 1.8 centimeters.

The hole can be located at a center between left and right sides of the tabbed note. In an implementation, a distance between a left side of the second slit and a closer side of the hole is approximately 0.6 centimeters, and a distance between a right side of the second slit and a closer side of the hole is approximately 0.6 centimeters.

Figure 22:
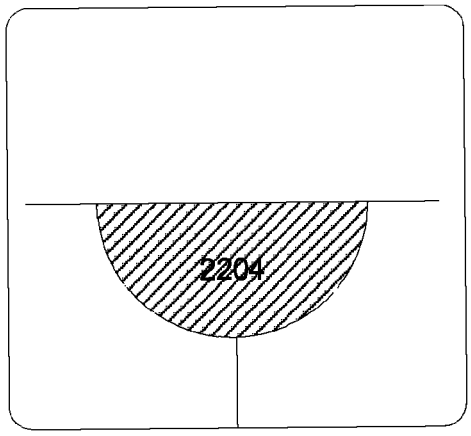
FIG. 22 shows an opening having a semicircle shape.
Figure 23:
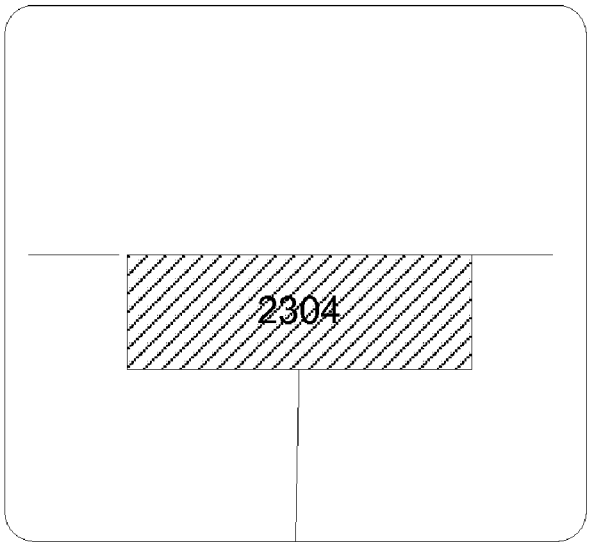
FIG. 23 shows an opening having a rectangular shape.

The opening in FIGS. 11 and 18 have a triangular shape, and the opening in FIGS. 20-21 have curved sides. This is not intended to limit the invention. For example, FIG. 22 shows an opening 2204 having a semicircle shape. FIG. 23 shows an opening 2304 having a rectangular shape. Other shapes such as stars or trapezoids are also possible.

In the figures, the tabbed note has rounded corners on four sides. This is not intended to limit the invention. In another implementation, there may be rounded corners on any number of sides such as one, two, three, or more (in the case the tabbed note is a polygon having more than four corners). For example, an implementation has two rounded corners for the first portion and two nonrounded corners (e.g., square corner) for the second portion. The amount of rounding of the rounded corners may vary. In another implementation, the tabbed note is a trapezoid, pentagon, or hexagon. Further, the tabbed note is not limited to being a four-sided, five-sided, or six-sided polygon. In some instances, a tabbed note may not be a polygon. For example, in an implementation, the shape of the tabbed note is a character, oval, animal, or other combination of these, or other shape.

Figure 24:
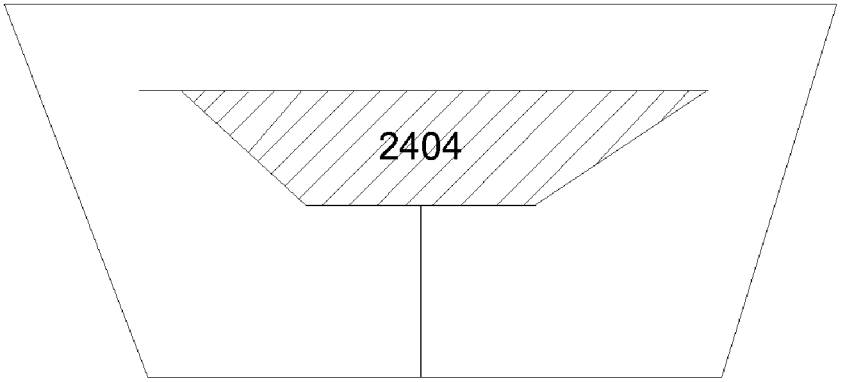
FIG. 24 shows a tabbed note having a trapezoidal shape.
Figure 25:
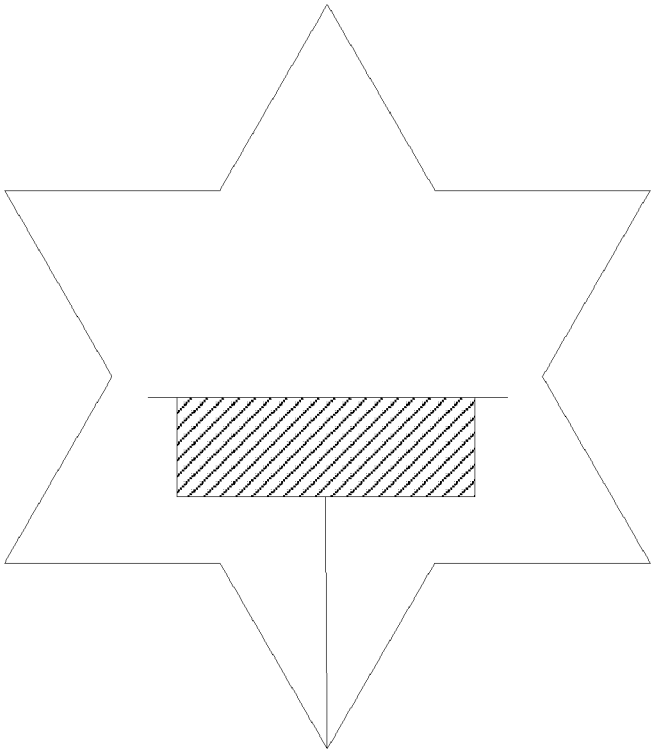
FIG. 25 shows a tabbed note having a star shape.
Figure 26:
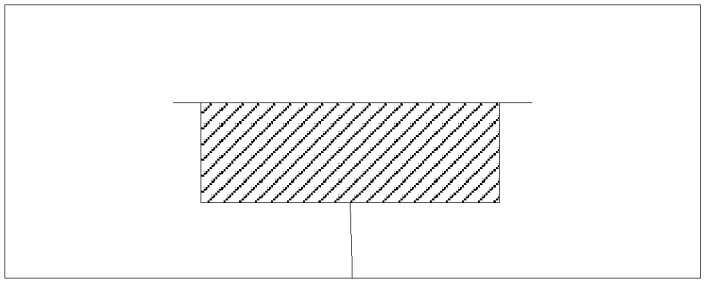
FIG. 26 shows a tabbed note having a rectangular shape.

For example, FIG. 24 shows a tabbed note having a trapezoidal shape. FIG. 25 shows a tabbed note having a star shape. The tabbed note can have other shapes. FIG. 26 shows a tabbed note having a rectangular shape.

In FIGS. 20-21, a distance between a left side of the tabbed note and the first slit is substantially equal to a distance between a right side of the tabbed note and the first slit. Other figures described a "T" slit. This is not intended to limit the invention. In other embodiments of the invention, the slits can be arranged in a different manner.

Figure 27:
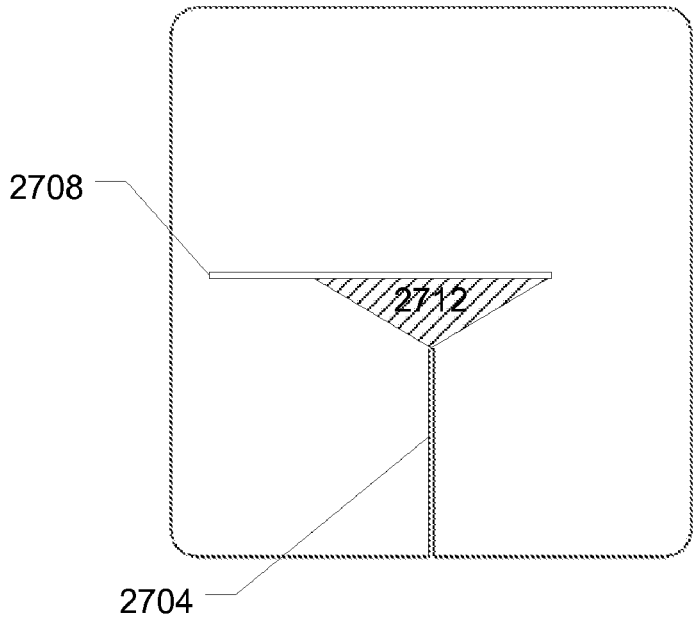
FIG. 27 shows a tabbed note having a first slit, a second slit, and an opening.

FIG. 27 shows a tabbed note having a first slit 2704, a second slit 2708, and an opening 2712. A distance between a left side of the tabbed note and the first slit is not equal to a distance between a right side of the tabbed note and the first slit. The second slit is "offset" from the first slit.

Figure 28:
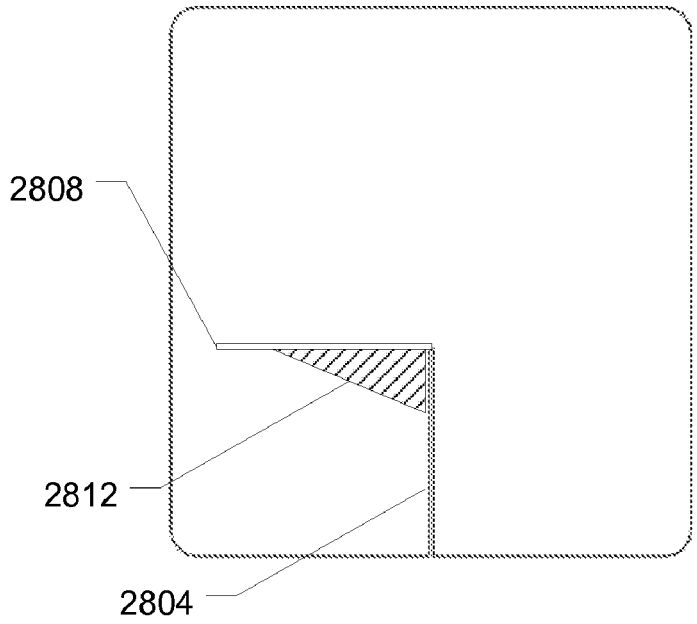
FIG. 28 shows a tabbed note having a first slit, a second slit, and an opening.

FIG. 28 shows a tabbed note having a first slit 2804, a second slit 2808, and an opening 2812. The first and second slits are in an "L" shape.

Further, the tabbed note assembly has been described as having two slits. This is not intended to limit the invention. The tabbed note assembly has more than two slits. In an implementation, the tabbed note assembly has three slits, four slits, or five slits.

The tabbed note may be formed from any suitable material, preferably a material which may be written on or imprinted. Suitable materials include, but are not limited to, card stock, paper, plastic, rubber, polymer, polyester, animal skin, leather, natural fibers, cotton, linen, fabric, parchment, Mylar®, or vellum. Mylar is a trademark of E.I. du Pont de Nemours and Company. Such materials may be reusable as writing or imprinting may readily be removed from the materials using erasers or correction fluid, for example, and new writing or imprinting may be placed on the materials. Permanent writing or printing may also be used.

Figure 29:
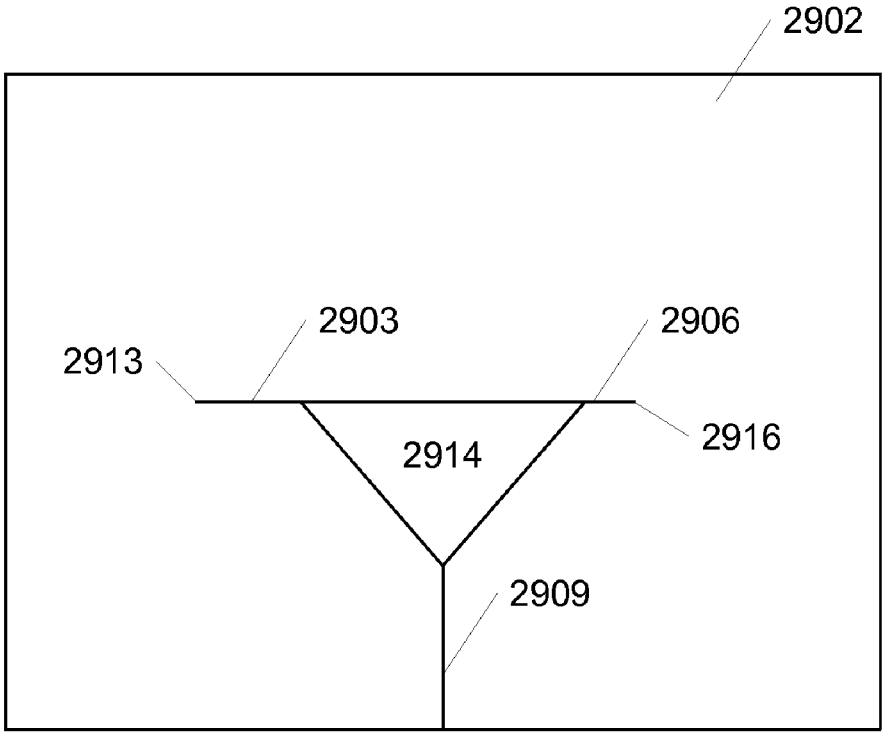
FIG. 29 shows a note sheet without the binder clip having an opening and three slits.

FIG. 29 shows a note sheet 2902 for a tabbed note of the invention without the binder clip. The note sheet is rectangular, but can also be other shapes as discussed above. In an implementation, the note sheet is rectangular and has rounded corner on all four corners. In another implementation, the note sheet is square and has rounded corner on all four corners. In other implementation, the note sheet can have a combination of square and rounded corners, such as two upper rounded corners on a top edge of the sheet, and two lower square corners on a bottom edge of the sheet. In various implementations, a width-to-length aspect ratio of the rectangular sheet can be, for example, 1:1 (square), 1.24:1, 1.2:1, 1.07:1, 1.05:1, 1.04:1, 0.97:1, 0.92:1. Other aspect ratios may be used.

Three slits 2903, 2906, and 2909 extend and touch an opening 2914. The opening has a triangular, closed shape. The shape can be another closed shape as described above including polygonal (e.g., square, rectangle, or trapezoid) and curved shapes (e.g., circular or semicircular). In an implementation, triangle opening 2914 can be centered vertically between left and right side edges of the sheet. However, in other implementations, triangle opening 2914 can be off center vertically. When the binder clip is inserted into the note sheet, triangle opening 2914 will no longer be visible from a front view of the note sheet and binder clip assembly. Slits 2903 and 2906 are parallel with each other, between left and right side edges of the note sheet and touch opening 2914 (at vertices of the opening). Slit extends to and touches both opening 2914 (at a vertex of the opening) and the bottom edge of sheet 2902. Slit 2909 is generally perpendicular to slits 2903 and 2906, and also the bottom edge of sheet 2902. However, in other implementations, slit 2909 can be at an angle with respect to the bottom edge of sheet 2902. Slit 2909 can be at an angle with respect slit 2903. Slit 2909 can be at an angle with respect slit 2906. For example, these angles can be not perpendicular, 89-75 degrees, 80 degrees, 70 degrees, 60 degrees, 50 degrees, 45 degrees, 30 degrees, or other.

A length of slits 2903 to 2906 are from an end 2913 to an end 2916 is the same or longer than a width of the binder clip. The binder clip will be inserted through slit 2909 and opening 2914, and then positioned into both slits 2903 and 2906. In an implementation, a length of slit 2903 is longer than slit 2906. So slits 2903 to 2906 from end to end will not be centered between left and right edges of the sheet. End 2913 will be closer to the left edge than end 2916 is to the right edge. However, when the binder clip positioned in the slits 2903 and 2906, the binder clip will be approximately centered between left and right edges on the sheet.

Slit 2903 is slightly longer to allow ease of insertion of the binder clip into the note sheet, Slit 2916 is slightly shorter to keep the total length of the paper cuts shorter (i.e., close to the width of the binder clip). Longer paper cuts will tend to reduce the rigidity and strength of the note.

However, in other implementations, a length of slit 2903 is the same as slit 2906. So slits 2903 to 2906 from end to end will be centered between left and right edges of the sheet. End 2913 will be the same distance from the left edge that end 2916 is from the right edge.

To manufacture slits 2903, 2906, and 2909 and opening 2914, these can be formed using a single die cut or punch on a note sheet 2902 (without the slits and opening). The size of the slits and holes are dependent upon the size of the binder clips. The bigger the binder clips, the bigger or longer the slits and holes are, or both, as well as the bigger the paper.

In another implementation, slit 2906 is optional and missing altogether. This note implementation will only have a slits 2903 and 2909, and no slit 2906. The width of the binder clip will fit within slit 2903 and opening 2914. With the three-slit implementation, it can be easier to center the binder clip on the sheet because the binder clip can be moved into slit 2906.

There note can have a color scheme, which help facilitate the use of the note as an organization tool. In an implementation, there can be note sheets of different colors, so that different colors can be used for different purposes. In an implementation, an individual note sheet can have two different colors or two different shades of the same color. For example, above slits 2903 and 2906 and opening 2914, there is a first color shade (e.g., dark orange). Below slits 2903 and 2906 and opening 2914, there is a second color shade (e.g., light orange). In various other implementations, the color scheme are dark pistachio-light pistachio, dark pink-light pink, dark purple-light purple, dark yellow-light yellow, dark red-light red, dark blue-light blue, and dark green-light green.

The binder clip can have a color finish such as metallic silver, polished silver, black, pink, purple, yellow, orange, blue, green, or others.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A tabbed note assembly comprising:

a tabbed note comprising:

a first side edge;

a second side edge opposite the first side edge;

a first slit in a first direction from the second side edge; and a second slit in a second direction, the second direction different from the first direction; and an opening between the first slit and the second slit; and a binder clip, the binder clip arranged to be positioned through the opening such that sides of the binder clip contact a front and a back of the tabbed note when the binder clip is in a closed position.

2. The tabbed note assembly of claim 1 wherein the first direction is perpendicular to the second direction.

3. The tabbed note assembly of claim 1 wherein the opening has a triangular shape.

4. The tabbed note assembly of claim 1 wherein the second slit has a length from about 0.7 centimeters to about 1.6 centimeters.

5. The tabbed note assembly of claim 1 wherein a length of the first slit has a length from about 0.4 centimeters to about 3 centimeters.

6. The tabbed note assembly of claim 1 wherein a length of the opening is less than a length of the first slit.

7. The tabbed note assembly of claim 1 wherein the opening has a semicircular shape.

8. The tabbed note assembly of claim 1 wherein the opening comprises a closed polygon having a first curved line extending from the second slit to a first point of the second slit, and a second curved line extending from the second slit to a second point of the second slit.

9. The tabbed note assembly of claim 1 wherein the opening comprises a rectangular shape.

10. The tabbed note assembly of claim 1 wherein the opening comprises a trapezoidal shape.

11. The tabbed note assembly of claim 1 wherein the tabbed note has a rounded rectangular shape.

12. The tabbed note assembly of claim 1 wherein the tabbed note has a star shape.

13. A tabbed note comprising:

a sheet material having an opening and at least a first and second slit, wherein the first and second slits extend to touch the opening, and the first slit extends to touch a bottom edge of the sheet material; and a binder clip, wherein the binder clip is inserted into the second slit, the second slit not touching an edge of the sheet material, and the binder fastened and positioned to block the opening from a front view of the note.

14. The tabbed note of claim 13 wherein the first and second slits are perpendicular to each other.

15. The tabbed note of claim 13 wherein the opening has a triangular shape.

16. The tabbed note of claim 13 wherein the opening has an edge with a length of at least 1.4 centimeters.

17. A kit comprising:

a package, the package having a plurality of compartments, the plurality of compartments including a first compartment and a second compartment;

a first plurality of tabbed note assemblies, the first plurality of tabbed note assemblies including a first tabbed note assembly having a first tabbed note and a first binder clip, the first tabbed note having a first tab portion and a first note portion, the first note portion and the first tab portion being defined by a different colored printing in these portions, the first tabbed note having a first opening which is blocked from a front view by the first binder clip, wherein the first plurality of tabbed notes is positioned at least partially in the first compartment; and a second plurality of tabbed note assemblies, the second plurality of tabbed note assemblies including a second tabbed note assembly having a second tabbed note and a second binder clip, the second tabbed note having a second tab portion and a second note portion, the second note portion and the second tab portion being defined by a different colored printing in these portions, the second tabbed note having a second opening which is blocked from a front view by the second binder clip, wherein the second plurality of tabbed notes is positioned at least partially in the second compartment.

18. The kit of claim 17 wherein the first opening has a triangular shape.

19. The kit of claim 17 wherein the first tabbed note comprises a first slit touching and extending from an edge to the first opening.

20. The kit of claim 17 wherein the first and second colored printings are different from each other.

* * * * *